US011168478B1

(12) United States Patent
Hall

(10) Patent No.: US 11,168,478 B1
(45) Date of Patent: Nov. 9, 2021

(54) ARTIFICIAL INSULATED LOG

(71) Applicant: Clint Hall, Kenai, AK (US)

(72) Inventor: Clint Hall, Kenai, AK (US)

( * ) Notice: Subject to any disclaimer, the term of this patent is extended or adjusted under 35 U.S.C. 154(b) by 0 days.

(21) Appl. No.: 16/148,359

(22) Filed: Oct. 1, 2018

(51) Int. Cl.

| | |
|---|---|
| ***E04C 3/29*** | (2006.01) |
| ***E04C 3/12*** | (2006.01) |
| ***E04B 2/70*** | (2006.01) |
| ***E04B 1/10*** | (2006.01) |
| *E04B 2/06* | (2006.01) |
| *E04B 2/02* | (2006.01) |
| *E04C 2/24* | (2006.01) |

(52) U.S. Cl.
CPC ..... *E04C 3/29* (2013.01); *E04B 2/702* (2013.01); *E04C 3/122* (2013.01); *E04B 1/10* (2013.01); *E04B 2/02* (2013.01); *E04B 2/06* (2013.01); *E04C 2/243* (2013.01)

(58) Field of Classification Search
CPC . E04C 3/29; E04C 3/122; E04C 2/243; E04B 2/702; E04B 1/10; E04B 2/02; E04B 2/06
See application file for complete search history.

(56) References Cited

U.S. PATENT DOCUMENTS

| | | | | |
|---|---|---|---|---|
| 3,552,079 | A * | 1/1971 | Mortensen | E04B 2/702 52/592.6 |
| 4,344,263 | A * | 8/1982 | Farmont | E04B 2/702 52/233 |
| 4,503,648 | A * | 3/1985 | Mahaffey | E04B 2/709 52/223.7 |
| 7,823,351 | B2 * | 11/2010 | Tiberi | B29C 44/1233 52/233 |
| 2002/0157334 | A1 * | 10/2002 | Smith | E04B 2/702 52/233 |
| 2009/0133345 | A1 * | 5/2009 | Wrightman | E04B 2/702 52/233 |
| 2010/0043323 | A1 * | 2/2010 | Wrightman | E04B 2/702 52/233 |

* cited by examiner

*Primary Examiner* — Brian D Mattei
*Assistant Examiner* — Omar F Hijaz
(74) *Attorney, Agent, or Firm* — Michael J. Tavella

(57) ABSTRACT

An artificial insulated log that has outer and inner wood members that are glued to an inner core of rigid insulation. In addition to the glue, structural connectors are fitted on the top of the logs at specified intervals to provide additional structure support, Each of the wood pieces has a tongue and groove formed to receive other logs. In addition, the insulated core is also fitted with a tongue and groove for alignment. The outer, or exterior, wood member is curved to look like a natural log, The inner wood members are cut flat to for a flat interior wall. Formed corner logs can be used with regular logs to make a finished looking assembly for the building. The corners can be alternated or stacked, as desired.

19 Claims, 21 Drawing Sheets

ARTIFICIAL INSULATED LOG

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to artificial logs and particularly to artificial logs that have insulation in them.

2. Description of the Prior Art

In North America, log cabins and homes go back to the beginnings of settlement. For much of this time, log homes and cabins were built by stacking logs to form walls. Logs are notched to interlock as the walls rise. This produces a stable structure that has solid logs for walls. However, these walls have gaps between the logs, which allowed the weather to enter. To solve this problem, "chinking" was developed. Originally, this involved filing the gaps with mud and other natural substances until the gaps were sealed. This did provide protection from the weather, but required annual chinking to replace worn patches.

Mud chinking was replaced in the twentieth century with fiberglass insulation that was held in place with adhesives. Also, new compounds were developed to better seal log structures that eliminated the need for annual chinking.

Also, in the twentieth century, people began replacing natural logs with other forms. Some used prefabricated elements to make simulated logs that had insulation built into them. Some examples of these can be found in the following U. S. Patents. In U.S. Pat. No. 3,992,838, logs are flat planed on the tops and bottoms. Then long troughs are formed in the top and bottom, which are filled with insulation. Mortises are formed in the centers of the tops and bottoms to receive splines that connect the logs. In this way, logs can be stacked together to form a wall that has no spaces between the logs. Moreover, the logs have rounded sides that simulate the look of a traditional log structure. In one embodiment, the logs can be squared off on one side to make for flat walls on the interior. Although these logs are insulated and do not need chinking, their design does not allow the stacking of alternating logs to make the traditional log corners found on log structures. U.S. Pat. No. 4,147,000 teaches a log wall that consists of two log walls with insulation fitted between them. While this structure is an insulated log wall, it is very thick compared to an average log structure. The wall in this patent is the equivalent of about three logs thick. That produces an expensive and difficult wall to build. U.S. Pat. No. 4,305,238 teaches a simulated log structure that utilizes formed pipes that are filled with insulation. The pipes have simulated wood grain on their outer surfaces and are stacked with splines to hold the wall together. U.S. Pat. No. 4,344,263 teaches another log wall that has logs with troughs formed in them to receive insulation. This patent uses a series of metal nailing strips in the logs to provide stability. Unlike the previous patent, this patent has tongues formed on the top of the log, and matching grooves on the bottom of the log. These tongues fit into the grooves to tie the logs together. U.S. Pat. No. 4,567,701 teaches a wall structure that uses rounded wood pieces on an exterior that look like logs and flat wood pieces on the interior with insulation placed between them. This is not a wall that uses logs. Two vertical mullions are used to hold the structure together. In this wall, a simulated log construction can be erected. U.S. Pat. No. 4,951,435 teaches a traditional log structure that modifies the logs by making V grooves on the logs. This allows insulation to be placed between them, essentially eliminating the chinking. This structure does nothing to improve the insulation of the log walls themselves. U.S. Pat. No. 5,115,609 teaches a method of making a log wall by cutting logs in half, turning them so the curved parts are inside and then filling the space with insulation. The result is a square "log wall". U.S. Pat. No. 5,253,458 teaches the use of PVC pipes that are filled with insulation, plumbing and wiring. These pipes are stacked up to make a wall. Long bolts tie everything together. In one embodiment, the pipes have flat notches cut into them. This allows them to be stacked like logs in a traditional log structure. The PVC pipe are precast with simulated wood grain to look like logs. Finally, U.S. Pat. No. 8,225,565 teaches logs that have a vertical channel cut into them. This channel allows the introduction of insulation, plumbing and electrical systems. Note that the channels are vertical and do not extend through the entire log.

BRIEF DESCRIPTION OF THE INVENTION

The instant invention is an artificial insulated log that has outer and inner wood members that are glued to an inner core of rigid insulation. In addition to the glue, structural connectors are fitted on the top of the logs at specified intervals to provide additional structure support, In some embodiment, the wood pieces has a tongue and groove formed to receive other logs. In others, the logs are able to nest together. In addition, the insulated core is also fitted with a tongue and groove for alignment. The outer, or exterior, wood member is curved to look like a natural log, The inner wood members are cut flat to for a flat interior wall. To build a wall, the assembled logs are stacked up on each other. An adhesive sealant is applied to the bottom of the rigid insulation member. Log screws are driven into the wood members until the threaded bottom extend downward into the log below. Walls are joined by corners that cover the ends of the logs to make the installation neat and weather tight. In this way walls of any height can be quickly erected.

Thus, it is an object of this invention to provide an insulated, artificial log that has a continuous block of insulation running the full length of the log and extending from the top of the log to the bottom—with no gaps.

It is another object of the invention to provide an insulated, artificial log that has structural supports that connect the inner and outer wood members to provide greater structural integrity.

It is yet a further object of the invention to provide an insulated, artificial log with substantial inner and outer wood members that add to the structural integrity of the invention, such that additional support beams and posts ate not required in the building.

It is yet a further object of the invention in which the outer wood member has a pleasing log shaped profile and further in which the inner wood member has an appealing interior surface.

DETAILED DESCRIPTION OF THE INVENTION

Figure 1:
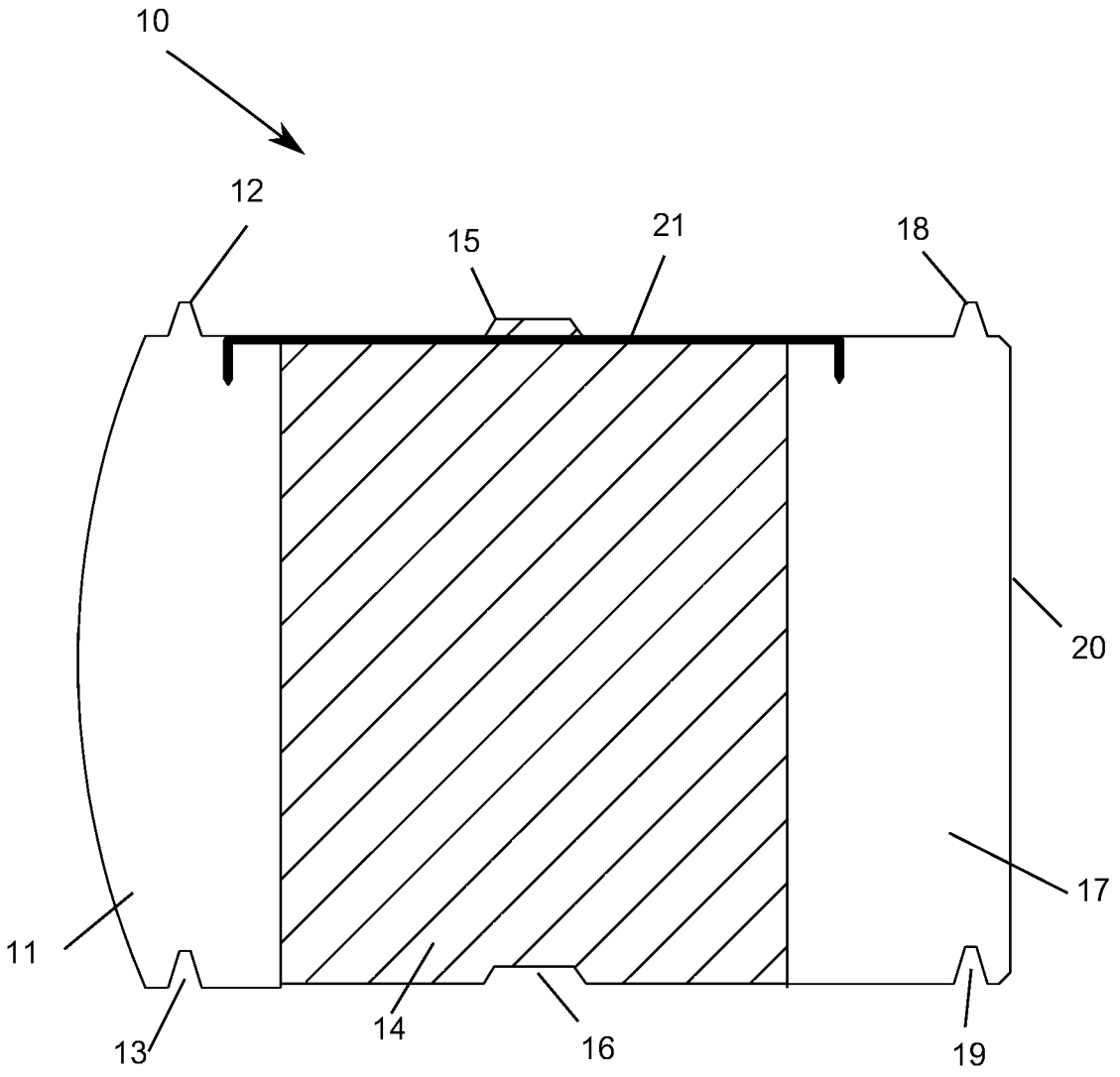
FIG. 1 is an end view of the preferred embodiment of artificial log.
Figure 7:
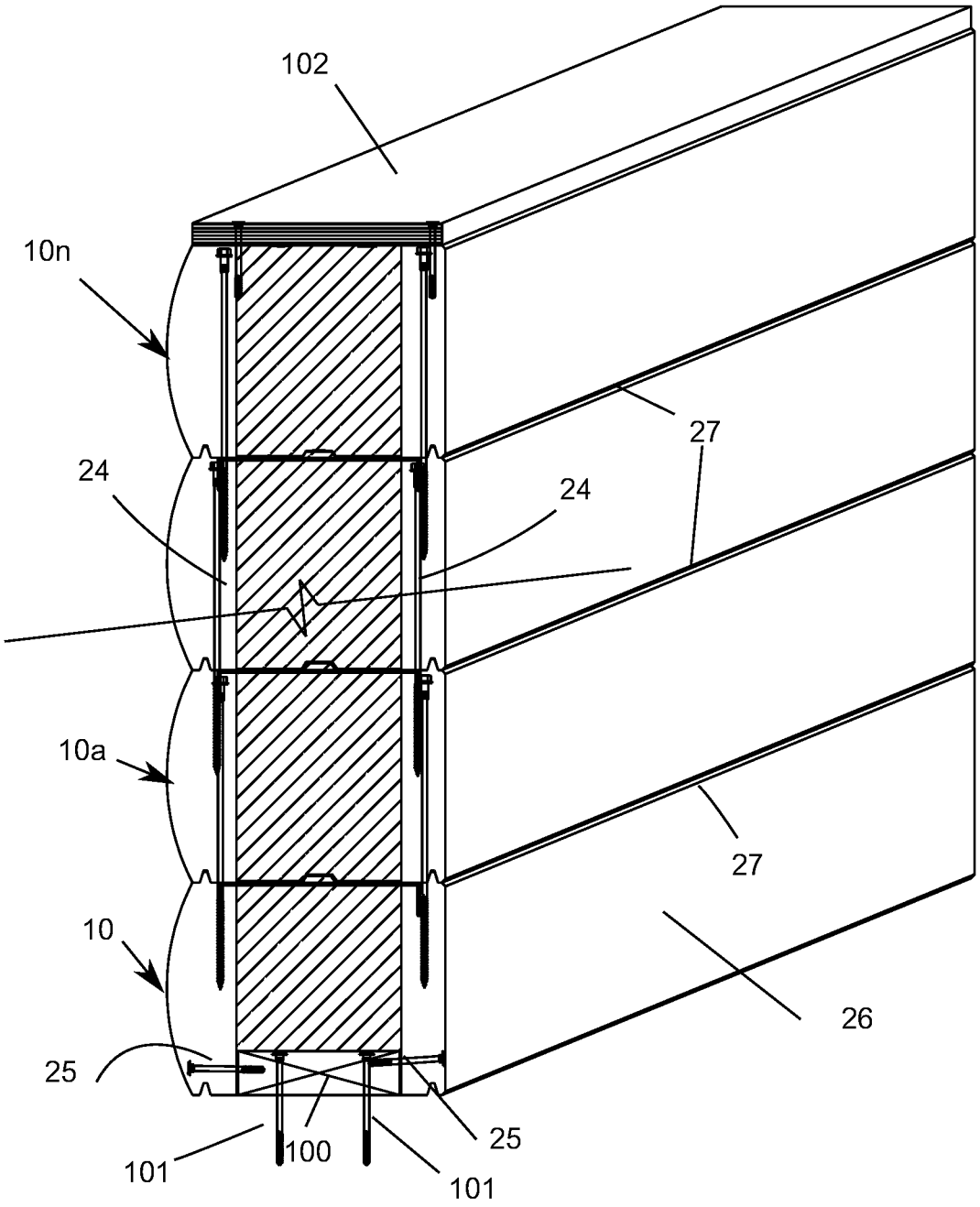
FIG. 7 is a detail perspective view of a wall section formed using the preferred embodiment of artificial logs.

Referring now to the drawings and particularly FIG. 1, an end view of the preferred embodiment of artificial log 10 is shown. In this embodiment, the log 10 is made up of an exterior wood member 11 that has a curved outer face, an upper tongue 12, and a lower groove 13 as shown. Both the tongue 12 and groove 13 help to align the log to others, as discussed below. The exterior wood member 11 is glued to a block of rigid insulation 14. This block of insulation runs the same length as the exterior wood member. Note that, in the preferred embodiment, the block of insulation has an alignment tongue 15 and an alignment groove 16 as shown. An interior wood member 17 is glued to the other side of the block of insulation 14. The interior wood member also has an upper tongue 18, and a lower groove 19 as shown. The interior wood member 17 has a flat inner surface 20. This allows for a smooth finish interior wall (see, e. g. FIG. 7). The log 10 is further strengthened by a number of structural connectors 21 that are driven into the exterior and interior wood members and that span the width of the insulation block. The glue used is one compatible with wood and the particular type of insulation used.

Figure 2:
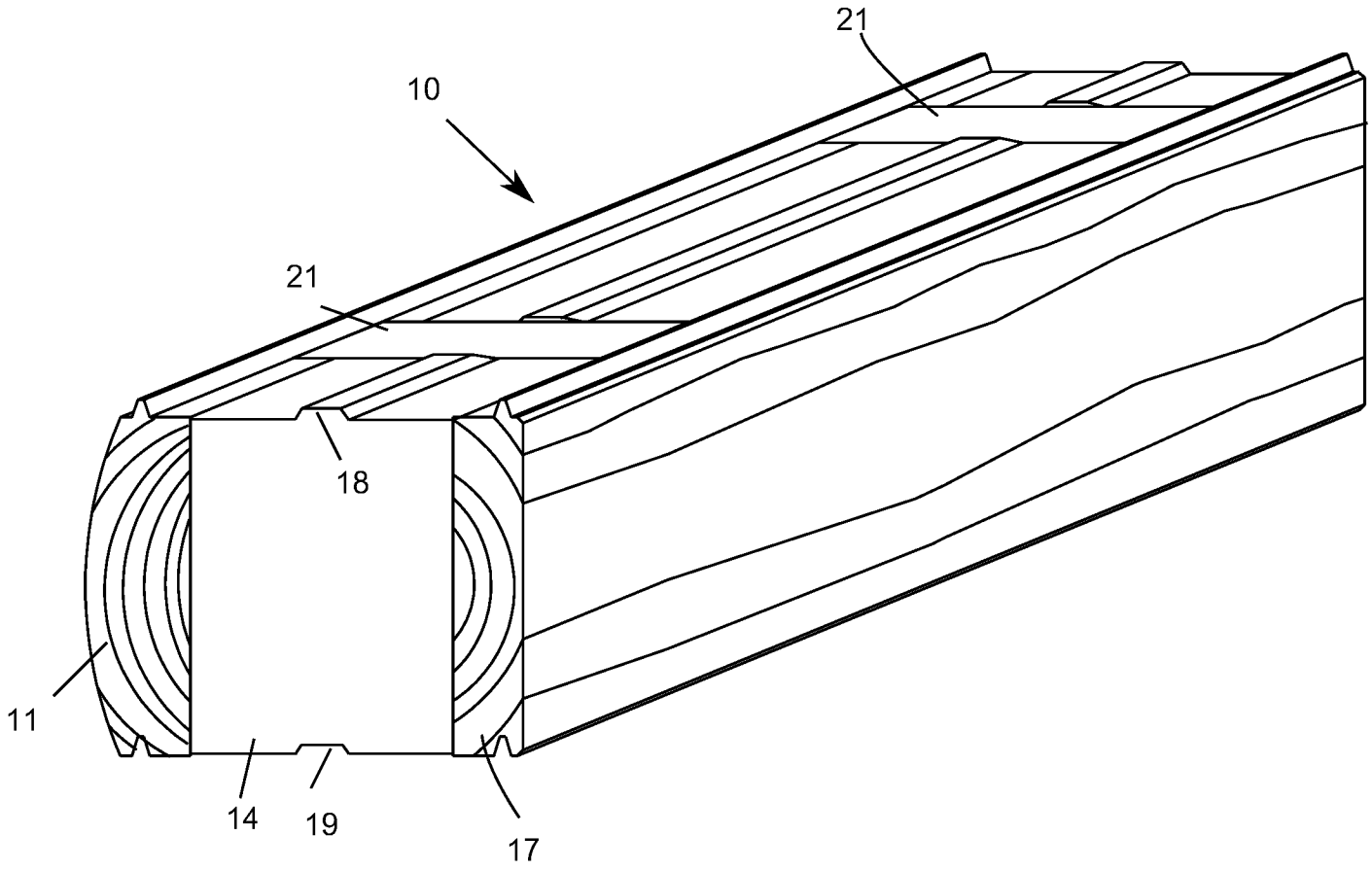
FIG. 2 is a perspective view of the preferred embodiment of artificial log.

FIG. 2 is a perspective view of the preferred embodiment of artificial log. Here, the major elements are shown: the exterior wood member 11, the insulation block 14 and the interior wood member 17. Note that the structural connectors 21 do not run the length of the log. These members are spread out as shown. Not too that the upper tongue 18 is not continuous as it is shaved to accommodate the structural connectors 21.

Figure 3:
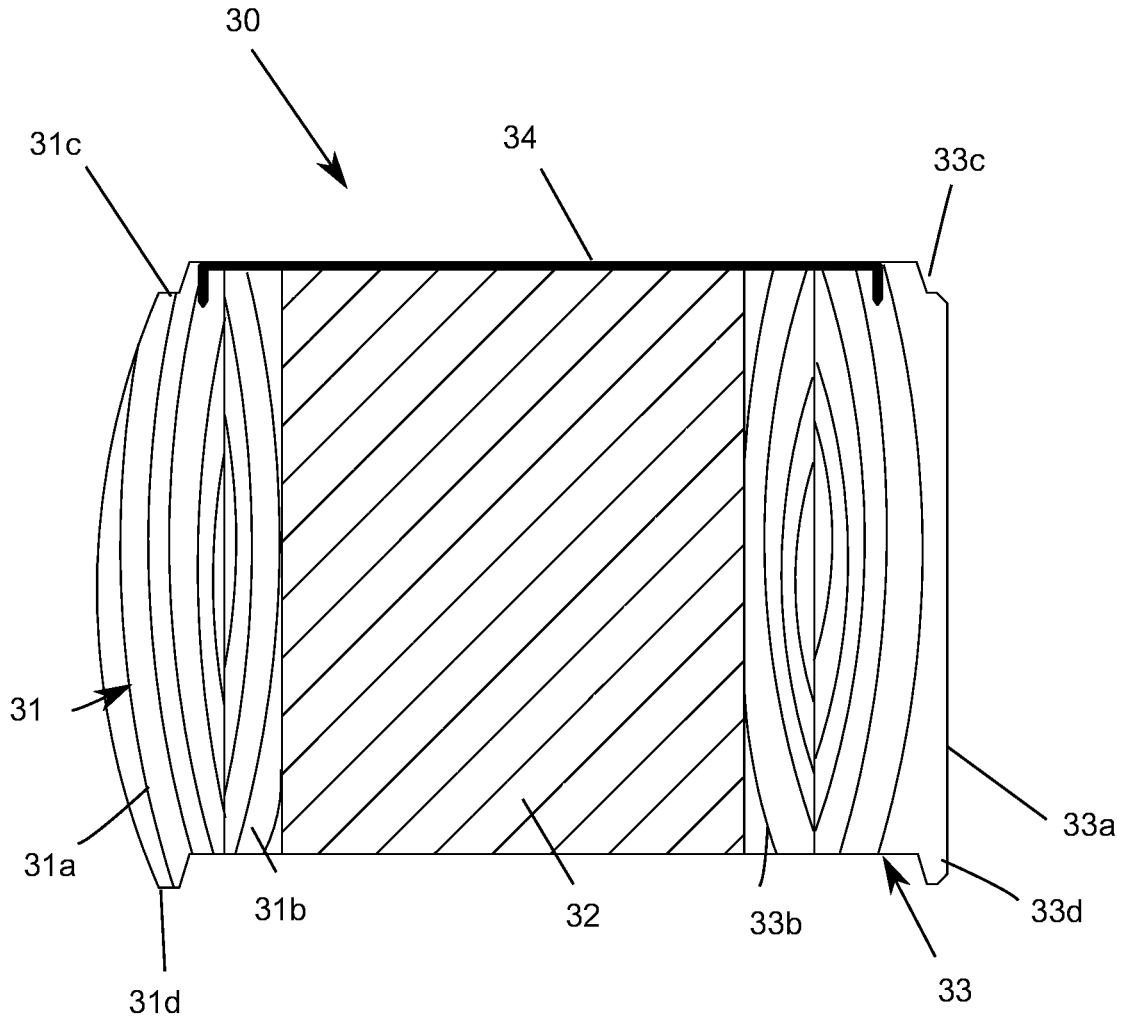
FIG. 3 is an end view of a second embodiment of artificial log.

FIG. 3 is an end view of a second embodiment of artificial log. In this embodiment, the log 30 has a two-part exterior wood member 31, made up of an outer piece 31*a* and an inner piece 31*b* that are glued together. A piece of rigid insulation 32 is glued to the inner piece 31*b* as shown. An interior wood member 33 is made up of an outer piece 33*a* and an inner piece 33*b* that are similarly glued together. As before, the inner piece 33*b* is glued to the rigid insulation 32. Note that in this embodiment, the insulation has no tongue or groove. Also, as before, a structural connector 34 is secured to the wood members as shown.

Note that in this embodiment, the alignment is accomplished by an upper notch 31*c* and a lower tang 31*d*, for the external wood member And a similar notch 33*c* and tang 33*d* on the internal wood member.

Figure 4:
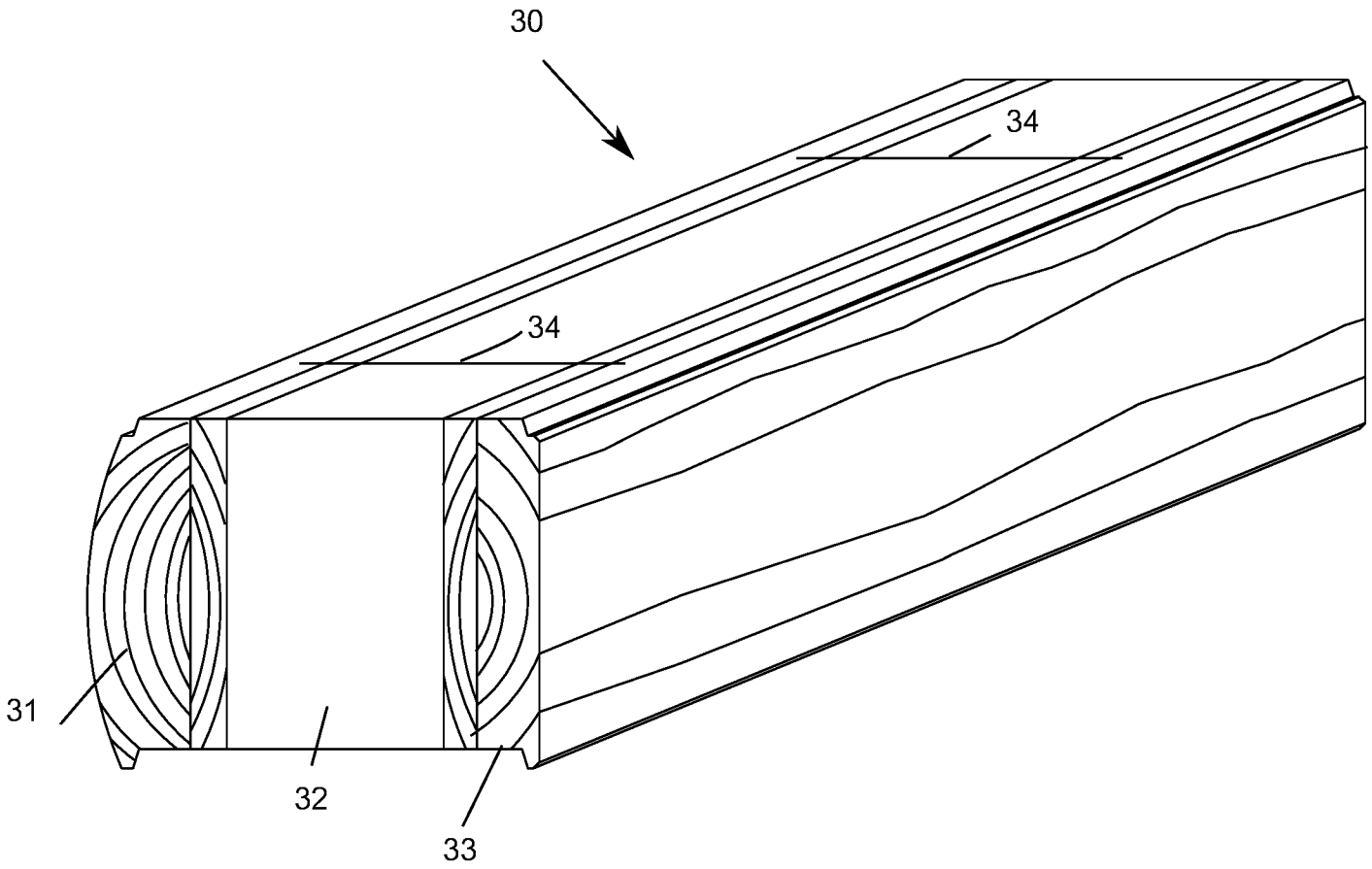
FIG. 4 is a perspective view of the second embodiment of artificial log.

FIG. 4 is a perspective view of the second embodiment of artificial log. In this view, the main members 31, 32 and 33 are shown as before. Note that the structural connectors in this embodiment are thin members rather than the wider member shown above in FIG. 2.

Figure 5:
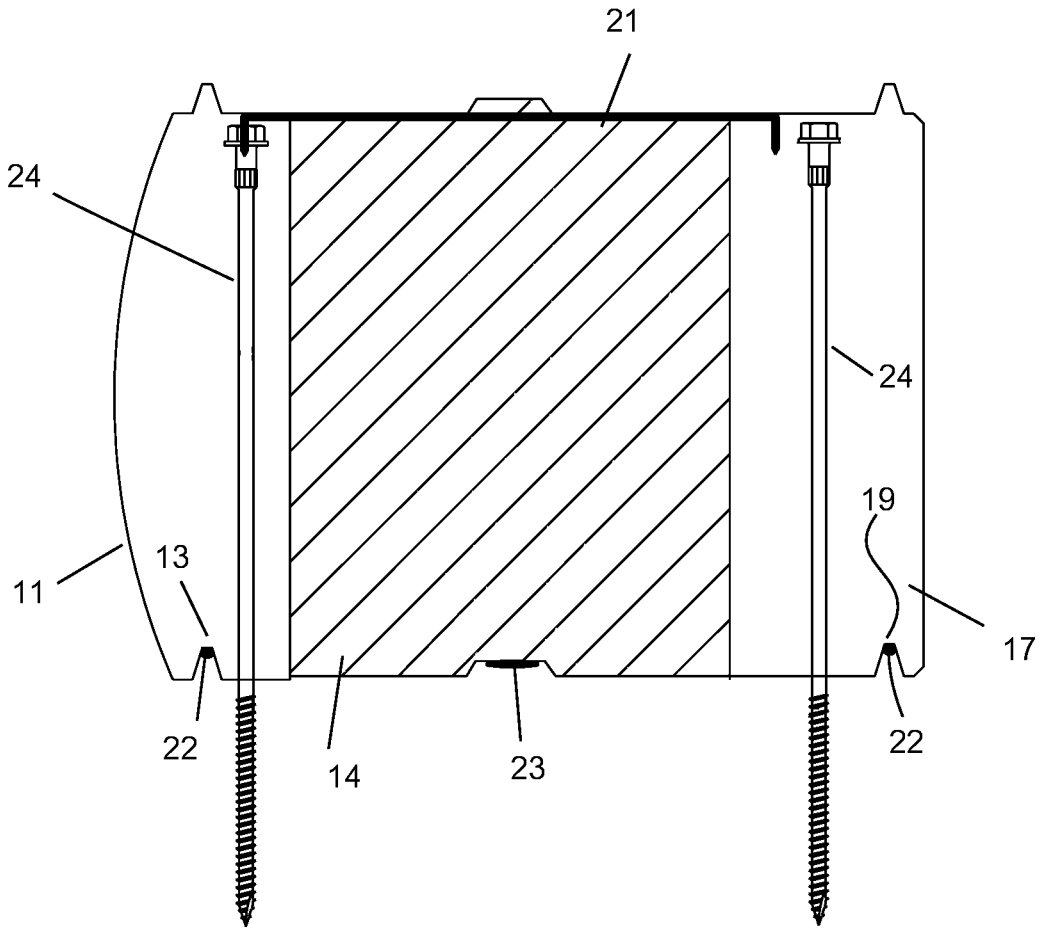
FIG. 5 is a detail view of the preferred embodiment showing log screws installed.
Figure 6:
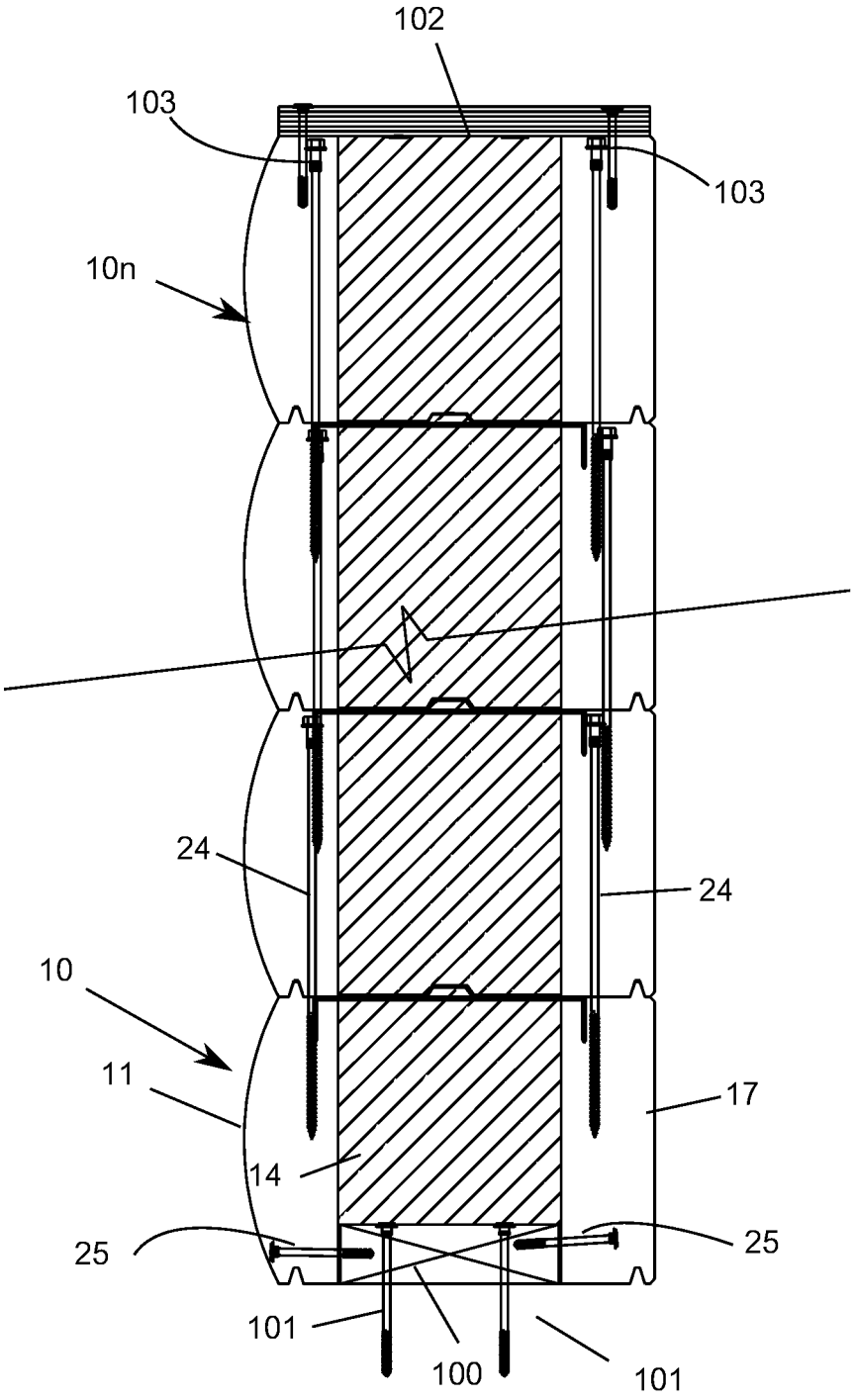
FIG. 6 is a detail end view of a wall section formed using the preferred embodiment of artificial logs.

FIG. 5 is a detail view of the preferred embodiment showing log screws installed. FIG. 6 is a detail end view of a wall section formed using the preferred embodiment of artificial logs. To build a wall using logs of the first embodiment, they are stacked one on top of another. To secure the logs, adhesive sealant 22 is placed in the grooves 13 and 19 of the exterior and interior wood members, respectively. In addition, adhesive sealant 23 is applied to the bottom of the insulation block as shown. Log screws 24 are then driven into both the interior and exterior wood members, as shown. Note that in FIG. 5, the screws protrude at the bottom of the log. That is because they penetrate into the log beneath, as shown in FIG. 6.

FIG. 6 shows the construction of a typical wall section. Before the first coarse of logs, a piece of lumber 100 having the thickness of the insulation is placed on the foundation boards and is screwed into the foundation with lag screws 101 at regular intervals. A section of the insulation 14 is removed to accommodate the height of the board 100 as shown. The exterior wood member 11, and the interior wood member 17 fit around the board 100 and are secured with screws at regular intervals. The next log 10*a* is placed onto the base log as shown and is secured using the adhesive and log screws 24 as shown. In this way, additional logs are added, each with adhesive sealant and log screws 24, as discussed above, until the desired height has been reached. The top log 10*n* is secured to the log beneath on a like manner. The top of the wall is then covered by a top plate 102 using screws 103. The top plate provides a flat, level surface for securing flooring joists for a second story, or roof components, which are beyond the scope of this patent A second story of logs is built up from the second story floor as before. Roofs and the flooring are built using standard techniques.

FIG. 7 is a detail perspective view of a wall section formed using the preferred embodiment of artificial logs. Here, the components discussed above are shown. Note the interior wall surface 26 that is flat. It does have separation lines 27 between each log, however, which have an aesthetic appeal.

Figure 8:
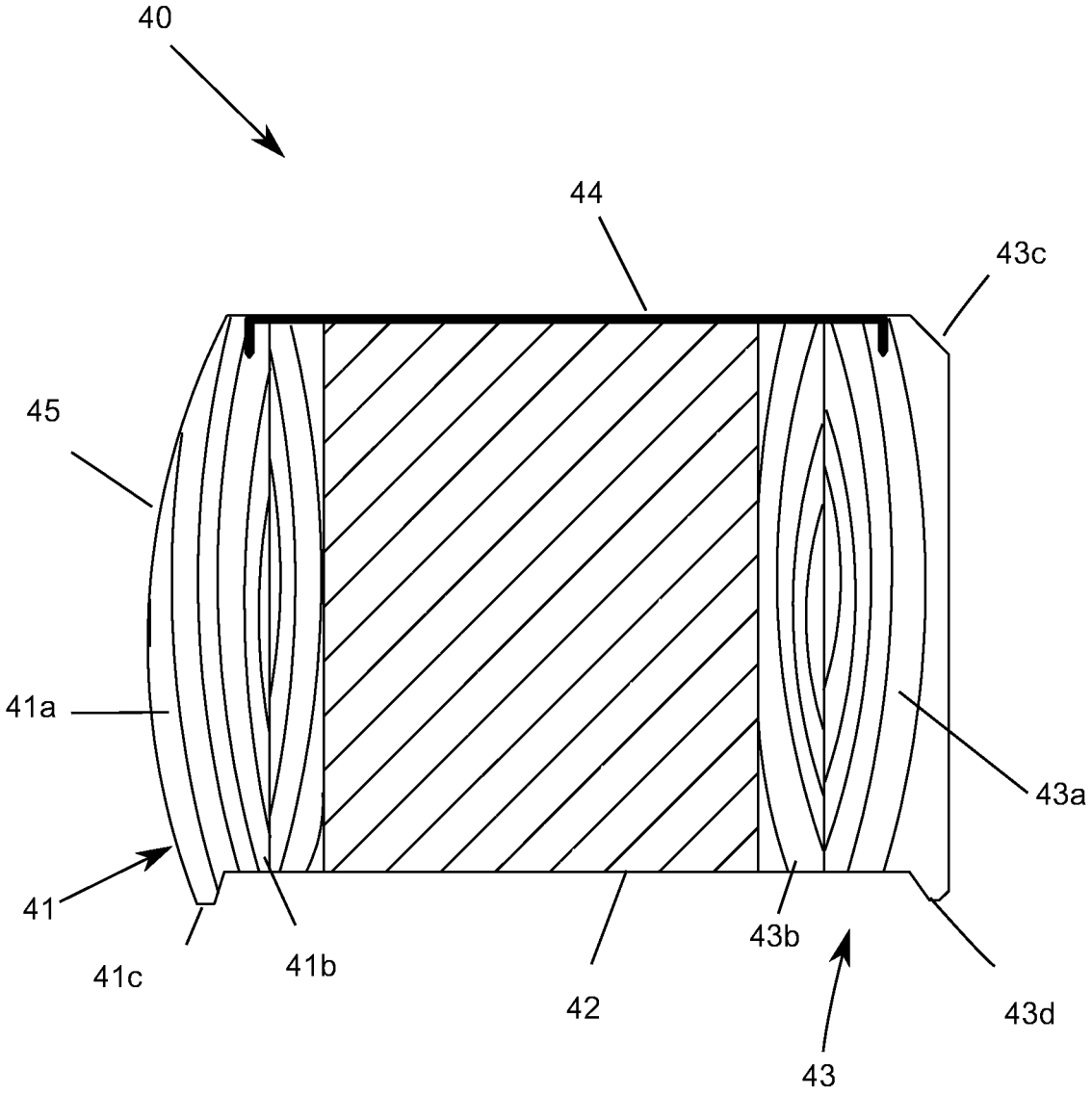
FIG. 8 is an end view of a third embodiment of artificial log.

FIG. 8 is an end view of a third embodiment 40 of artificial log. This embodiment is similar to that of the second embodiment. It has an exterior wood member 41 comprised of an outer member 41*a* and an inner member 41*b* that are glued together. There is an inner insulation block 42 and an interior wood member 43 comprised of an outer member 43*a* and an inner member 43*b* that are glued together. There is a structural connector 44 as well. The difference between this embodiment and the second embodiment is that the outer wood member has a smooth curved surface 45 that has no notch at the top, however, it does have a tang 41*c* as shown. The interior wood member 43 has a 45-degree slope 43*c* formed at the top instead of a notch and a tang 43*d* is formed at the bottom.

Figure 9:
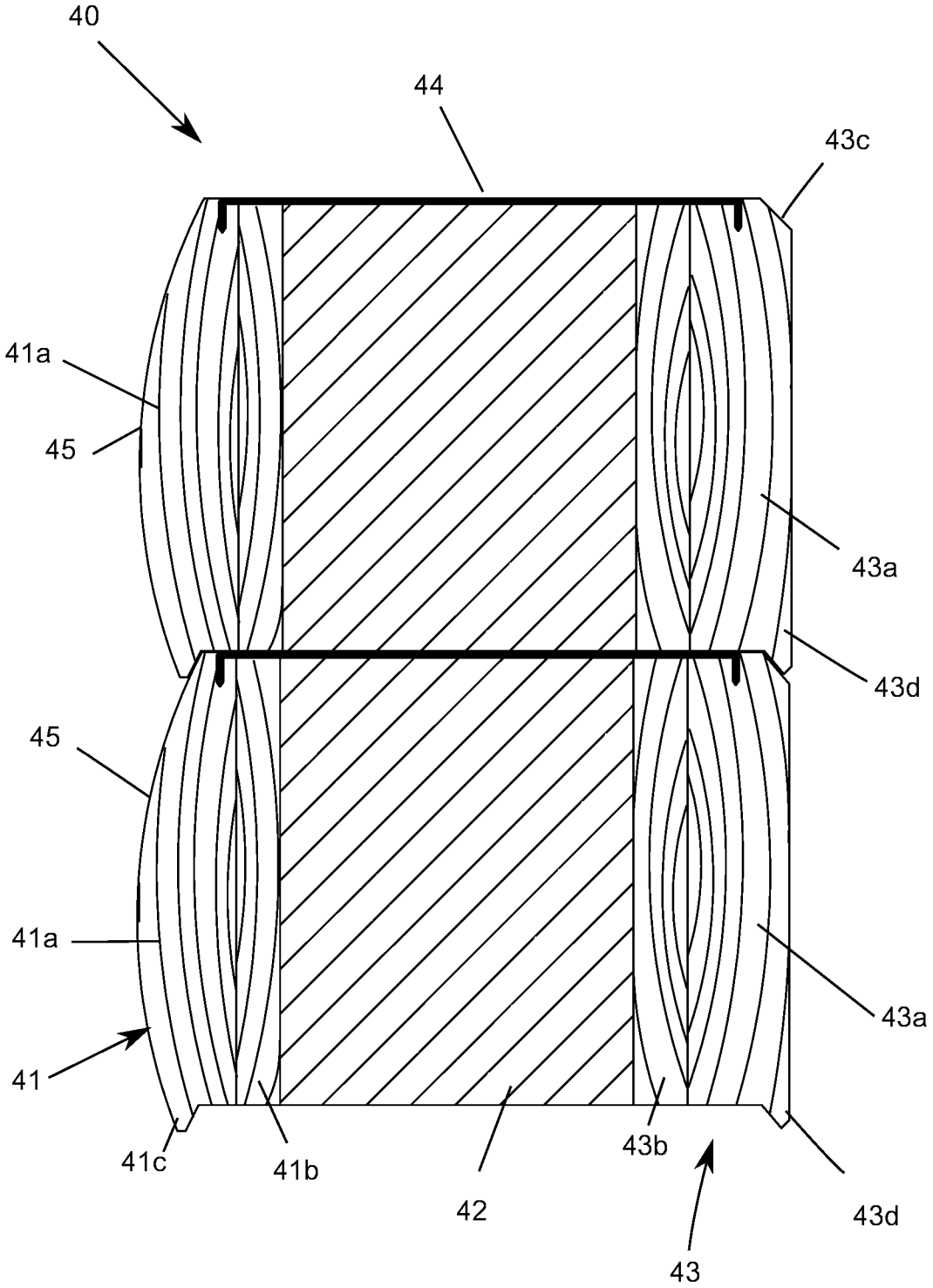
FIG. 9 is a detail end view showing two of the third embodiment logs stacked together.

FIG. 9 is a detail end view showing two of the third embodiment logs stacked together. Note the log screws are not shown in this figure. Note how the tang 41*c* fits over the smooth surface 45 of the log below. This provides a tight, weatherproof seal. Note too how the tang 43*d* fits against the 45-degree slope 43*c* of the log below.

Figure 10:
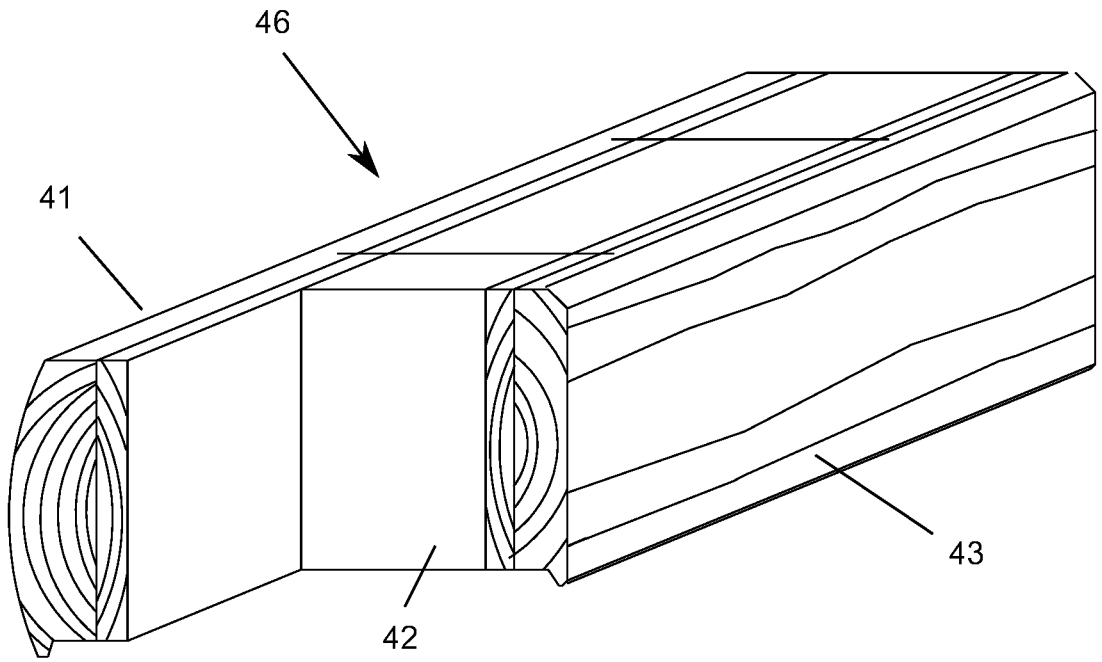
FIG. 10 is a detail perspective view of a third embodiment log forming one leg of a corner.
Figure 11:
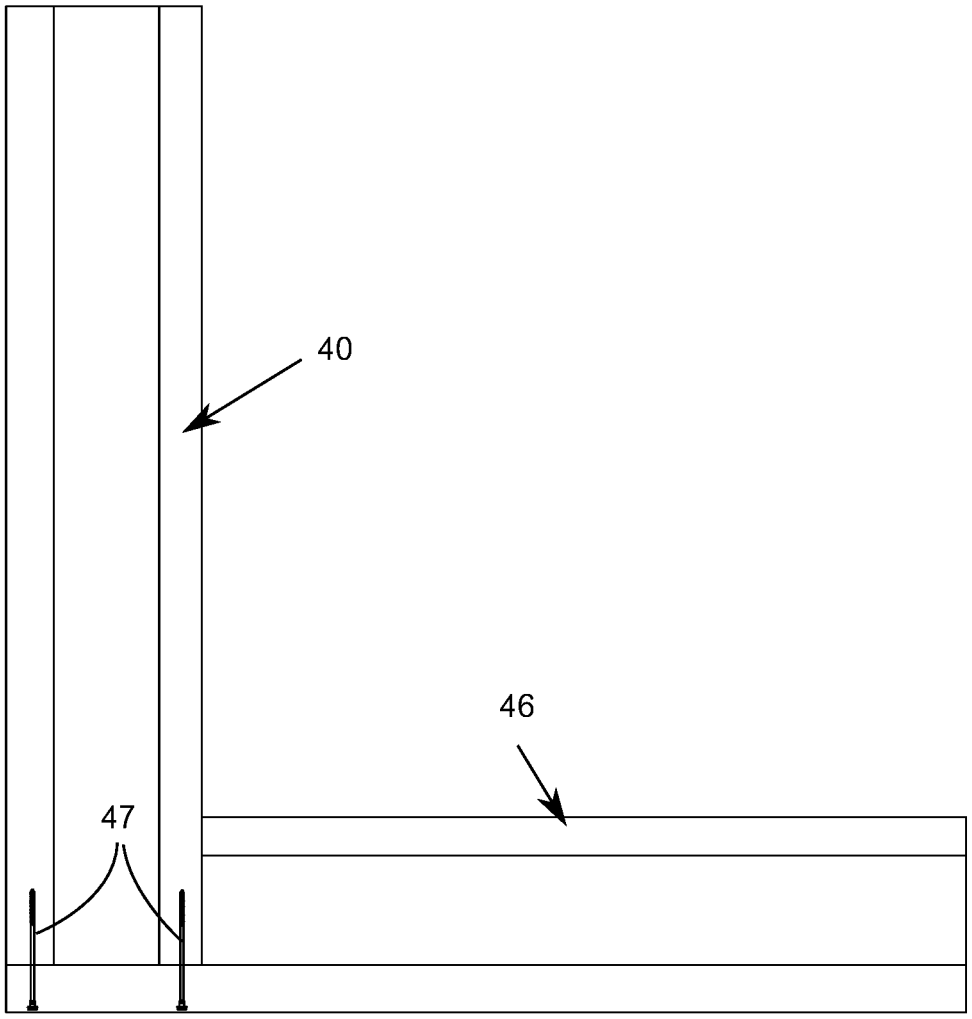
FIG. 11 is a detail top view of one type of corner formation using the artificial logs.
Figure 12:
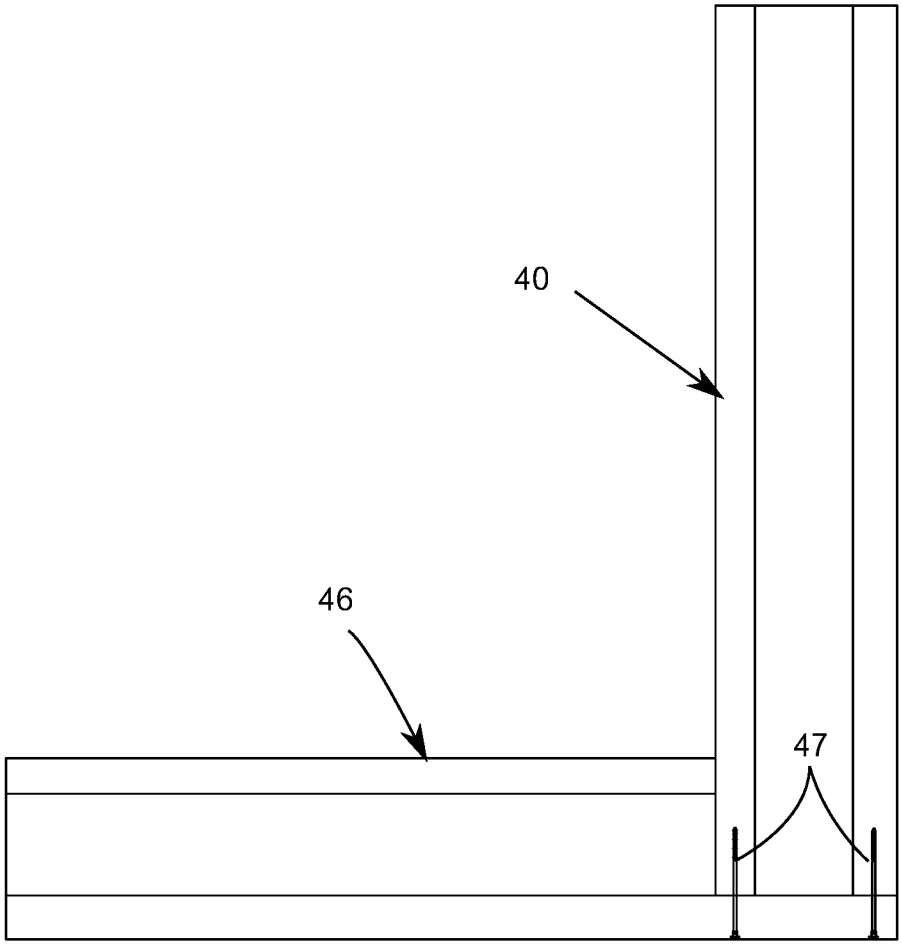
FIG. 12 is a detail top view of the opposite corner formation of FIG. 11, using the artificial logs.
Figure 13:
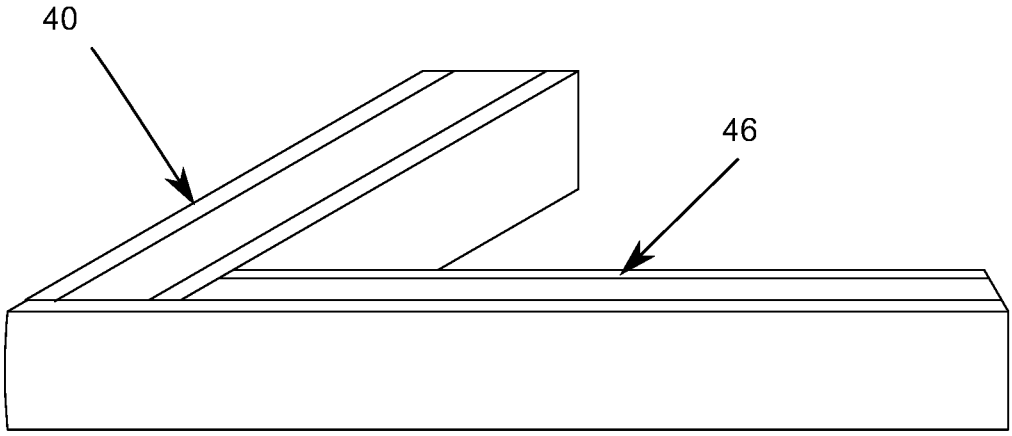
FIG. 13 is a front perspective view of the corner section of FIG. 11.
Figure 14:
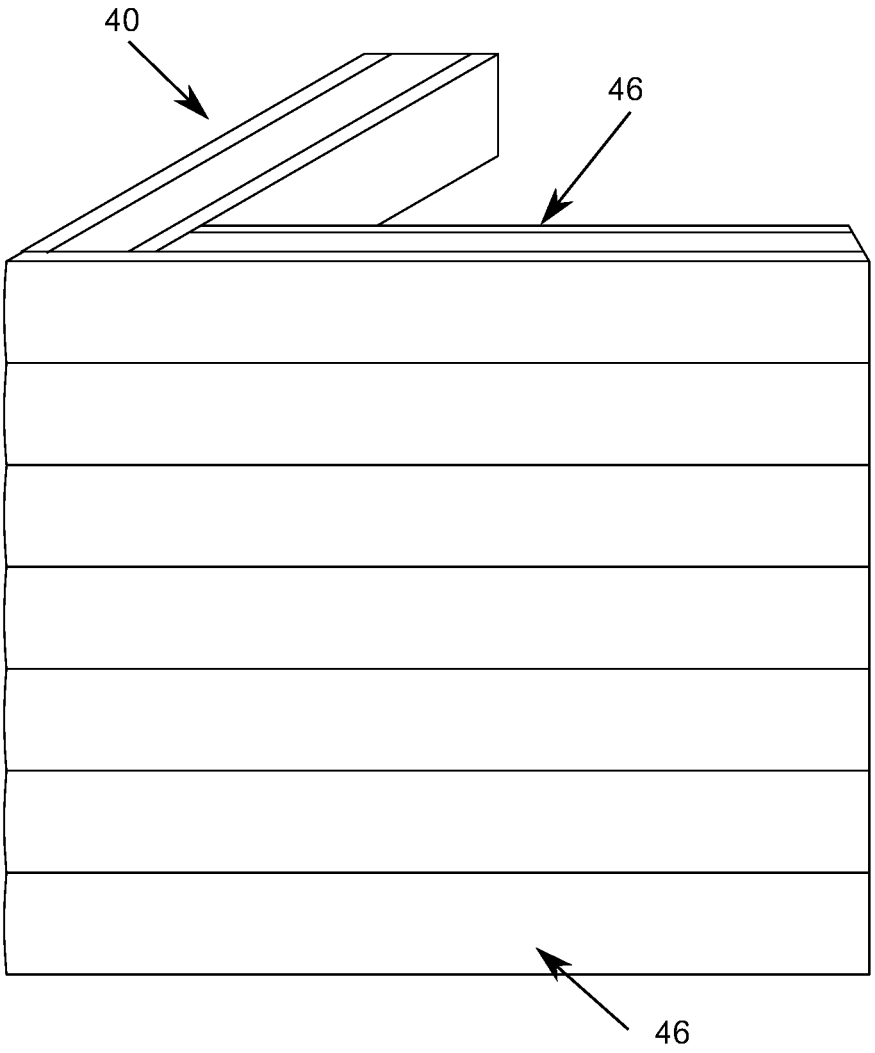
FIG. 14 is a front perspective wall section showing the corner section of FIG. 11.
Figure 15:
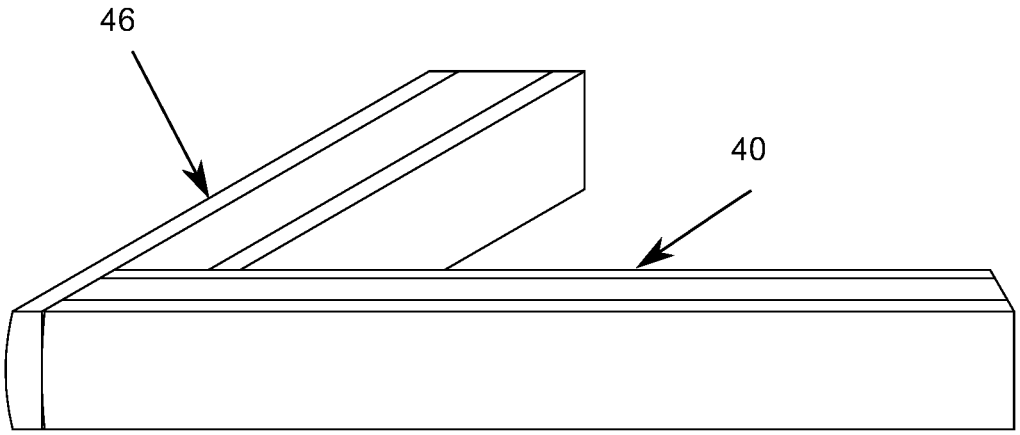
FIG. 15 is a front perspective view of an alternate corner section configuration.
Figure 16:
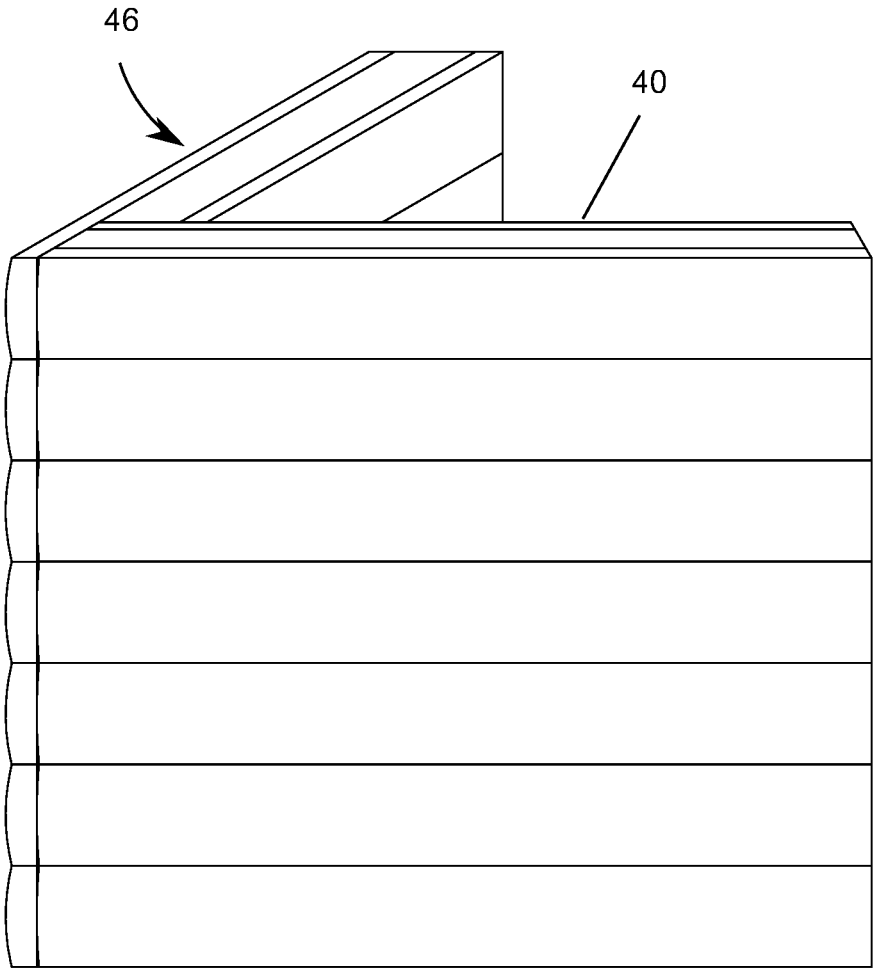
FIG. 16 is a front perspective wall section showing the corner section of FIG. 15.
Figure 17:
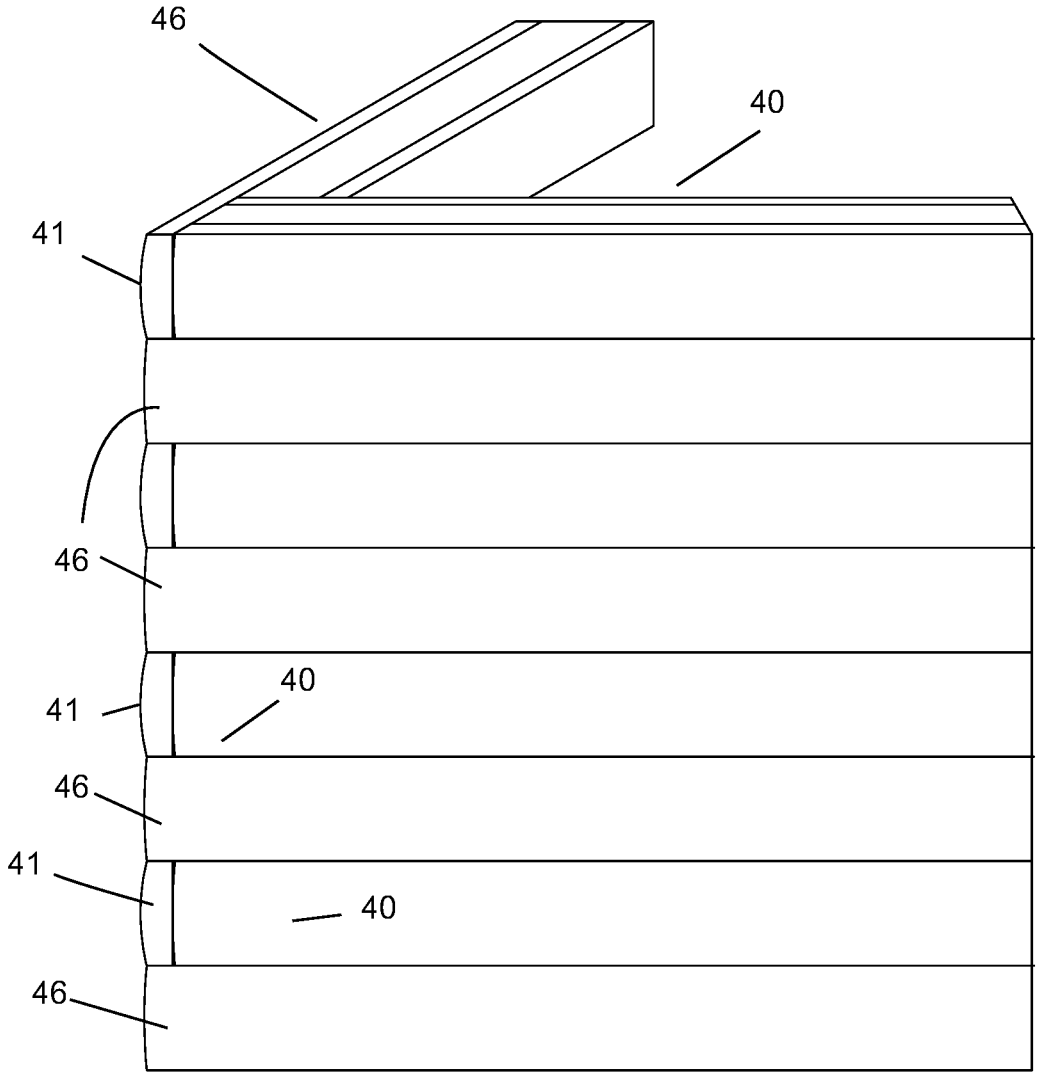
FIG. 17 is a front perspective wall section showing alternating corner sections of wall section.

When building with logs, the walls come together to make a corner. FIG. 10 is a detail perspective view of a third embodiment log forming one leg of a corner. To form a corner log 46, the inner parts of the log are cut back to form a ledge of the exterior wood member 41. Note that the insulation block 42 and the interior wood member 43 do not extend the full length of the log. Corner logs are designed to interlock with regular log pieces. FIG. 11 is a detail top view of one type of corner formation using the artificial logs. Here, a log 46 with a corner meets a regular log 40 (of course, this can be done with any of the log embodiments). Note that the corner log is screwed to the regular log with lag screws 47. This figure shows a left corner. FIG. 12 is a detail top view of the right corner formation, using the artificial logs. In this figure log 46 meets log 40 as before. Note the screws 47. FIG. 13 is a front perspective view of the corner section of FIG. 11. Walls can be erected using regular logs 40 meeting corner logs 46 (with corners on both ends) such as that shown in FIG. 14, which is a front perspective wall section showing the corner section of FIG. 11. On the other hand, the corner logs 46 can be flipped as shown in FIG. 15, which is a front perspective view of an alternate corner section configuration. Here, the corner is on the side, leaving the external wood member 41 showing. As wall built like this would look the one shown in FIG. 16, which is a front perspective wall section showing the corner section of FIG. 15. It is also possible to alternate the corner sections as shown in FIG. 17, which is a front perspective wall section showing alternating corner sections of wall section.

Figure 18:
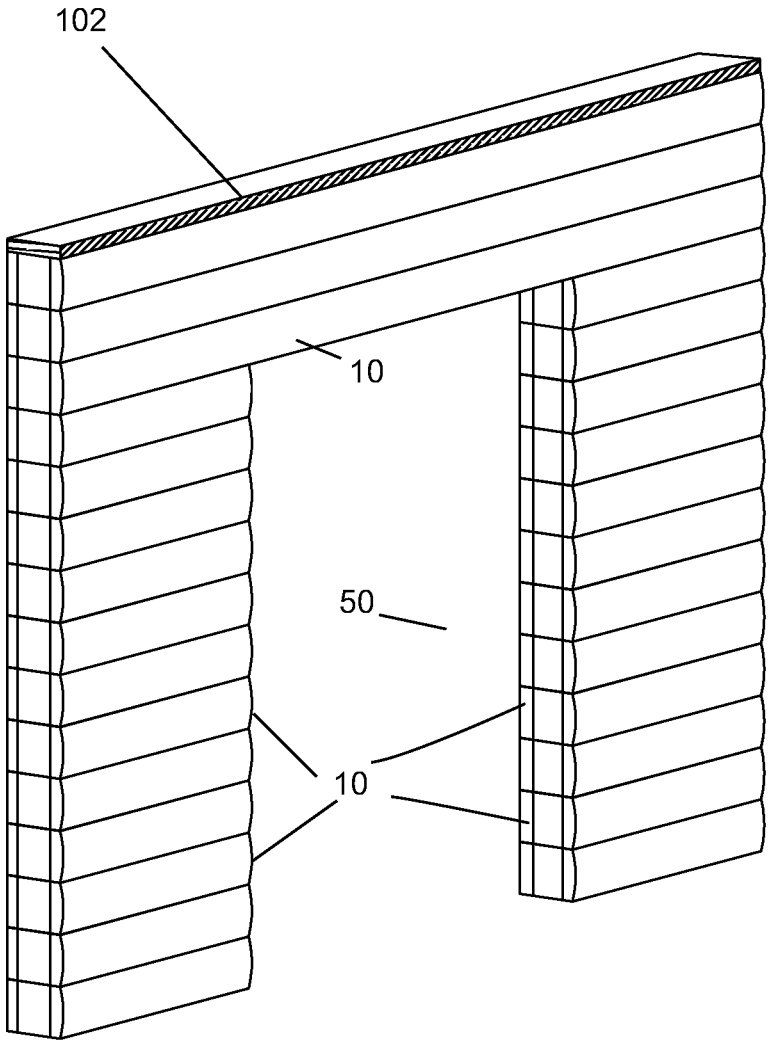
FIG. 18 is a detail of a wall section showing a door opening.
Figure 18A:
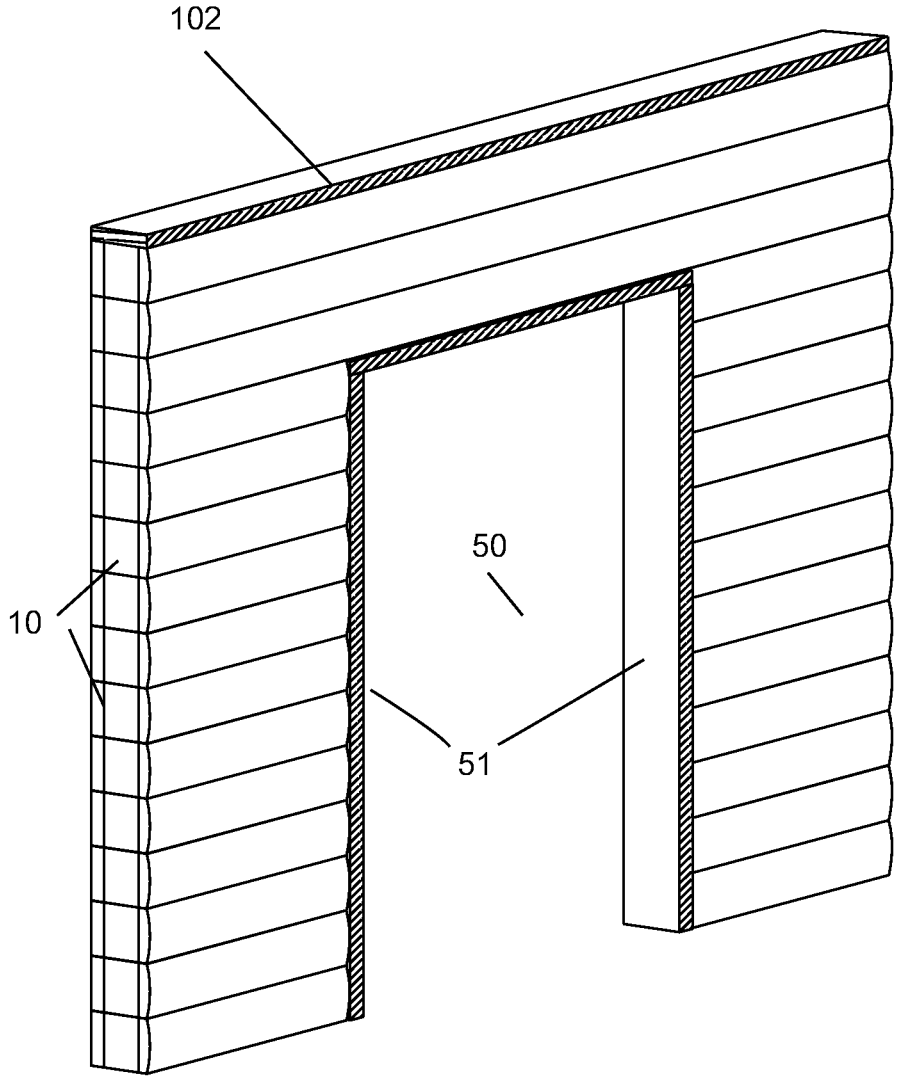
FIG. 18*a* is a detail of a wall section with a door opening shown framed.

Traditional log homes were built by using whole logs to build up the walls. Once the walls are complete, chain saws are used to cut openings for doors and windows. The logs provide ample beam strength to frame a door or a window. In the instant invention, however, this is not done. Buildings are designed with walls and doors. Walls are built up from the dimensions shown in the plans. Thus, shorter logs are used to frame a door with full-length logs forming a header. FIG. 18 is a detail of a wall section showing a door opening. Note again, the individual logs 10 are cut to specified dimensions first. Once the wall is erected, the door opening 50 can be framed with lumber 51 to allow the installation of a door using standard techniques. FIG. 18*a* is a detail of a wall section with a door opening shown framed.

Figure 19:
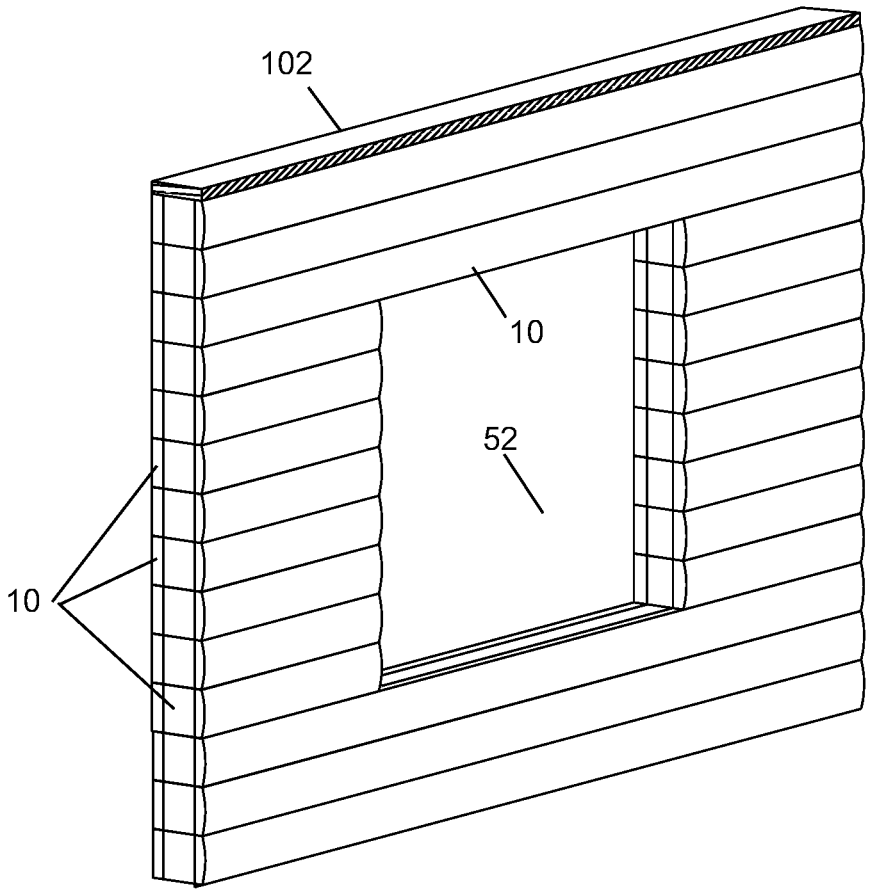
FIG. 19 is a detail of a wall section showing a window opening.
Figure 19A:
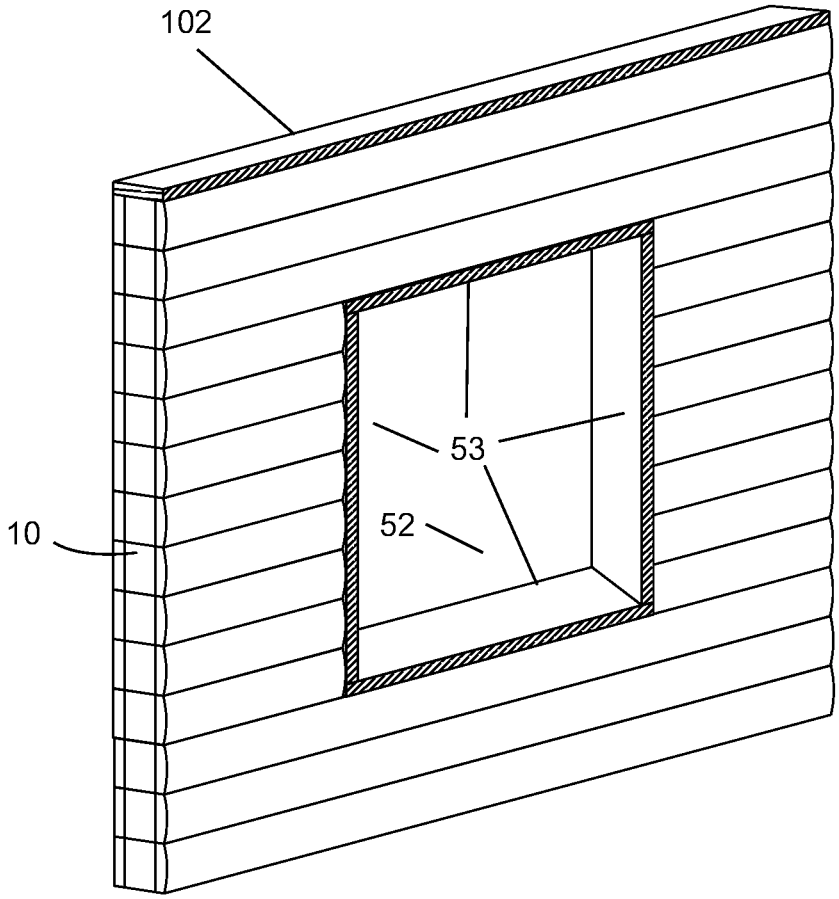
FIG. 19*a* is a detail of a wall section with a window opening shown framed.

Window openings are made in the same way. Full-length logs are placed for the lower few courses. When the window opening is formed, shorter length logs are used to form the window opening as specified in the plans. FIG. 19 is a detail of a wall section showing a window opening 52. As in the case of the door opening, the window opening 52 is framed with lumber 53 to accommodate window installation. FIG. 19*a* is a detail of a wall section with a window opening shown framed.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An artificial, insulated log having a bottom surface having a center portion, comprising:

a) an exterior wood member having an outer surface and an inner surface, a top and a bottom, said exterior wood member having a vertical orientation;

b) a block of insulating material, having a top, two sides, and a bottom, fixedly secured to the inner surface of said exterior wood member such that the bottom of said exterior wood member is generally flush with the block of insulating material;

c) an interior wood member having an inner surface and an outer surface, a top and a bottom, said interior wood member also having a vertical orientation, whereby said inner surface of said interior wood member being fixedly secured to said block of insulating material such that the bottom of said interior wood member is generally flush with the block of insulating material, and further such that the bottom of said block of insulating material forms the bottom center portion of said artificial, insulated log;

d) and further wherein said interior and exterior wood members are discrete, discontinuous members;

e) at least one structural connector having two ends with vertical flanges, said vertical flanges of said at least one structural connector being driven into the exterior and interior wood members such that said at least one structural connector spans the top of said block of insulating material;

f) wherein the exterior wood member has a generally curved outer surface and the interior wood member has a generally flat surface;

g) the exterior wood member has a tongue formed on the top and a groove formed on the bottom;

h) the interior wood member has a tongue formed on the top and a groove formed on the bottom; and i) the block of insulating material has a groove formed on the bottom and a discontinuous tongue formed at the top such that the discontinuous tongue is broken where the at least one structural connector is located on said block of insulating material.

2. A plurality of the artificial logs of claim 1 each having:

a) an exterior wood member having a top and a bottom, a tongue formed on the top and a groove formed on the bottom and having an outer surface and an inner surface;

b) a block of insulating material, having a top and a bottom, fixedly secured to the inner surface of said exterior wood member;

c) an interior wood member having a top and a bottom, a tongue formed on the top and a groove formed on the bottom, an inner surface and an outer surface, whereby said inner surface of said interior wood member being fixedly secured to said block of insulating material; and d) at least one structural connector attached to said exterior and interior wood members having two ends having vertical flanges, said vertical flanges of said at least one structural connector being driven into the exterior and interior wood members such that said at least one structural connector spans the top of said block of insulating material;

e) wherein the exterior wood member has a generally curved outer surface and the interior wood member has a generally flat surface.

3. A wall comprising the plurality of artificial logs of claim 2 having:

a) a base log, attached to a floor plate;

b) a plurality of intermediate logs, positioned above said base log, each of said intermediate logs having the tongues on said exterior and interior wood members and said block of insulating material engaging the grooves on said exterior and interior wood members and said insulating block, respectively, on the intermediate log above; and c) a top log, secured to a last intermediate log and having a top plate secured thereto.

4. The wall of claim 3 wherein each of the logs is secured by log screws.

5. The wall of claim 3 wherein each of the intermediate logs and the top log have beads of sealant placed between them.

6. The wall of claim 5 wherein the beads of sealant are placed in each of said grooves on each of said logs and further, sealant is placed on the bottom of said block of insulating material.

7. The artificial, insulated log of claim 1 wherein the exterior and interior wood members are made up of laminations comprising an outer wood piece and an inner wood piece and further wherein the inner and outer wood pieces are secured by a layer of glue therebetween.

8. The artificial log of claim 1 wherein the artificial log comprises:

a) said exterior wood member having an outer piece and an inner piece that are glued together to form a single lamination, said outer piece having a generally curved outer face, having a top and a bottom, said outer piece also having an upper notch formed at the top of said outer face, and further having a tang at the bottom of said outer face;

b) said block of insulating material comprising a piece of rigid insulation, glued to the inner piece of said exterior wood member;

c) said interior wood member having an outer piece and an inner piece that are glued together to form a lamination, said inner piece having a generally flat outer face having a top and a bottom, said inner piece also being glued to the piece of rigid insulation, said inner piece also having a notch formed on the top of the generally flat outer face and also having a tang formed on the bottom of said outer face of said inner piece; and d) said structural connector being secured to the exterior and interior wood members.

9. The artificial log of claim 1 wherein the artificial log comprises:

a) said exterior wood member having an outer piece and an inner piece that are glued together to form a single lamination, said outer piece having a generally curved outer face, having a top and a bottom, said outer piece also having a tang at the bottom of said outer face;

b) said block of insulating material comprising a piece of rigid insulation, glued to the inner piece of said exterior wood member;

c) said interior wood member having an outer piece and an inner piece that are glued together to form a lamination, said inner piece having a generally flat outer face having a top and a bottom, said inner piece also being glued to the piece of rigid insulation, said inner piece also having a 45-degree slope formed at the top of said generally flat outer face and also having a tang is formed at the bottom of said outer face of said inner piece; and d) said structural connector being secured to the exterior and interior wood members.

10. The wall of claim 3 further comprising: a door opening formed in said wall.

11. The wall of claim 10 wherein the door opening is framed with lumber.

12. The wall of claim 3 further comprising: a window opening formed in said wall.

13. The wall of claim 12 wherein the window opening is framed with lumber.

14. A pair of walls containing artificial, insulated log comprising:

a) a first log having:

i) an exterior wood member having an outer surface and an inner surface;

ii) a block of insulating material, having a top, two sides, and a bottom, fixedly secured to the inner surface of said exterior wood member;

iii) an interior wood member having an inner surface and an outer surface, whereby said inner surface of said interior wood member being fixedly secured to said block of insulating material;

iv) wherein the combination of the exterior wood member, block of insulating material and interior wood member have two ends, forming end faces for said first log v) at least one structural connector having two ends having vertical flanges, said vertical flanges of said at least one structural connector being driven into the exterior and interior wood members such that said at least one structural connector spans the top of said block of insulating material;

vi) wherein the exterior wood member on said first log has a generally curved outer surface and the interior wood member has a generally flat surface;

b) a corner log having i) an exterior wood member having an outer surface and an inner surface;

ii) a block of insulating material, having a top, two sides, and a bottom, fixedly secured to the inner surface of said exterior wood member;

iii) an interior wood member having an inner surface and an outer surface, whereby said inner surface of said interior wood member being fixedly secured to said block of insulating material;

iv) wherein said block of insulating material and said interior wood member are cut back to form a ledge of the exterior wood member that extends outward from the end of the block of insulating material and said interior wood member; and v) at least one structural connector having two ends having vertical flanges, said vertical flanges of said at least one structural connector being driven into the exterior and interior wood members such that said at least one structural connector spans the top of said block of insulating material;

vi) wherein the exterior wood member of said corner log has a generally curved outer surface and the interior wood member has a generally flat surface; and c) wherein said first log and said corner log are positioned orthogonally such that the ledge of said exterior wood member covers one of said end faces on said first log, thereby forming a log unit;

d) and further wherein a plurality of log units is stacked up, thereby forming an orthogonal wall unit.

15. The pair of walls of claim 14 wherein said first log and said corner log are stacked in an alternating pattern.

16. The pair of walls of claim 14 wherein:

a) the exterior wood members of said first log and said corner log have a tongue formed on the top and a groove formed on the bottom; and b) the interior wood members of said first log and said corner log have a tongue formed on the top and a groove formed on the bottom.

17. The pair of walls of claim 14 wherein: the exterior and interior wood members of said first log and said corner log are made up of laminations comprising an outer wood piece and an inner wood piece and further wherein the inner and outer wood pieces are secured by a layer of glue therebetween.

18. The pair of walls of claim 14 wherein:

a) said exterior wood members on said first log and said corner log each have a generally curved outer face, having a top, and a bottom, an upper notch formed at the top of said outer face, and further having a tang at the bottom of said outer face; and b) said interior wood members on said first log and said corner log each having a generally flat outer face having a top and a bottom, said interior wood members also having a notch formed on the top of the generally flat outer face and also having a tang formed on the bottom of said outer face of the interior wood member.

19. The pair of walls of claim 14 wherein:

a) said exterior wood members on said first log and said corner log each having a generally curved outer face, having a top and a bottom, and a tang at the bottom of said outer face; and b) said interior wood members on said first log and said corner log each having a generally flat outer face having a top and a bottom, said interior wood member also having a 45-degree slope formed at the top of said generally flat outer face and also having a tang is formed at the bottom of said outer face of the interior wood member.

* * * * *